US006431957B1

(12) United States Patent
Lefky

(10) Patent No.: US 6,431,957 B1
(45) Date of Patent: Aug. 13, 2002

(54) DIRECTIONAL FLOW CONTROL VALVE WITH RECIRCULATION FOR CHEMICAL-MECHANICAL POLISHING SLURRIES

(75) Inventor: Charles F Lefky, Oro Valley, AZ (US)

(73) Assignee: Parker-Hannifin Corporation, Cleveland, OH (US)

( * ) Notice: Subject to any disclaimer, the term of this patent is extended or adjusted under 35 U.S.C. 154(b) by 48 days.

(21) Appl. No.: 09/730,967

(22) Filed: Dec. 6, 2000

Related U.S. Application Data

(60) Provisional application No. 60/177,966, filed on Jan. 25, 2000.

(51) Int. Cl.[7] ..... B24B 1/00

(52) U.S. Cl. ..... 451/36; 451/41; 451/60; 451/446; 239/446; 137/625.66; 137/597

(58) Field of Search ..... 451/36, 41, 59, 451/60, 99, 285, 286, 287, 288, 289, 290, 446, 447; 137/625.66, 597; 239/446, 583, 586

(56) References Cited

U.S. PATENT DOCUMENTS

| | | | | |
|---|---|---|---|---|
| 3,357,451 A | | 12/1967 | Tennis | |
| 3,742,981 A | * | 7/1973 | Byers | 137/625.63 |
| 3,744,518 A | | 7/1973 | Stacey | |
| 3,744,522 A | | 7/1973 | Haffner et al. | |
| 3,827,453 A | | 8/1974 | Malott et al. | |
| 3,854,499 A | | 12/1974 | Sievenpiper | |
| 3,858,485 A | | 1/1975 | Rosaen et al. | |
| 3,911,957 A | * | 10/1975 | McQueen | 137/625.38 |
| 4,022,425 A | | 5/1977 | Govzman et al. | |
| 4,051,868 A | * | 10/1977 | Anderson | 137/596.13 |
| 4,167,197 A | | 9/1979 | Maki et al. | |
| 4,274,443 A | | 6/1981 | Faix | |
| 4,294,287 A | | 10/1981 | Boswell | |
| 4,489,758 A | * | 12/1984 | Malarz et al. | 137/881 |
| 4,495,962 A | | 1/1985 | Hattori et al. | |
| 4,526,201 A | | 7/1985 | Geyler, Jr. et al. | |
| 4,569,372 A | * | 2/1986 | Blank | 137/625.66 |
| 5,643,406 A | | 7/1997 | Shimomura et al. | |
| 5,658,185 A | | 8/1997 | Morgan, III et al. | |
| 5,664,990 A | | 9/1997 | Adams et al. | |
| 5,755,614 A | | 5/1998 | Adams et al. | |
| 5,791,970 A | | 8/1998 | Yueh | |
| 5,855,792 A | | 1/1999 | Adams et al. | |
| 5,895,315 A | | 4/1999 | Pinder, Jr. | |
| 5,928,492 A | | 7/1999 | Corlett et al. | |
| 5,992,294 A | | 11/1999 | Seddon | |
| 5,993,647 A | | 11/1999 | Huang et al. | |
| 6,170,524 B1 | * | 1/2001 | Gray, Jr. | 123/458 |
| 6,325,102 B1 | * | 12/2001 | Misumi et al. | 137/625.64 |

FOREIGN PATENT DOCUMENTS

| | | |
|---|---|---|
| EP | 0 879 979 A2 | 11/1998 |
| GB | 2 199 115 A | 6/1988 |

* cited by examiner

*Primary Examiner*—Timothy V. Eley
*Assistant Examiner*—Alvin J. Grant
(74) *Attorney, Agent, or Firm*—John A. Molnar, Jr.

(57) ABSTRACT

A valve particularly for use within a chemical-mechanical polishing (CMP) system for controlling the supply of slurry and de-ionized water streams while allowing for the constant recirculation of those streams. The valve includes a body having a bore with first and second inlet and outlet port openings for the slurry and water streams, and a third outlet port opening selectably couplable with the first and second inlet ports. A spool or other valve element is slidably received within the bore for axial movement therein, and is positionable within the bore in a null orientation closing the third outlet port to the first and second inlet ports. The spool is movable from the null orientation to a first operating orientation opening the third outlet port path to the first inlet port, and to a second operating orientation opening the third outlet port to the second inlet port.

20 Claims, 7 Drawing Sheets

DIRECTIONAL FLOW CONTROL VALVE WITH RECIRCULATION FOR CHEMICAL-MECHANICAL POLISHING SLURRIES

CROSS-REFERENCE TO RELATED CASES

The present application claims priority to U.S. Provisional Application Serial No. 60/177,966; filed Jan. 25, 2000.

BACKGROUND OF THE INVENTION

The present invention relates broadly to directional flow control or diversion valves, and more particularly to a valve of such type which is of spool-type variety and which is especially adapted for use in chemical-mechanical polishing (CMP) for controlling the supply of de-ionized water and slurry streams while allowing for constant recirculation of those streams.

In the general mass production of semiconductor devices, hundreds of identical "integrated" circuit (IC) trace patterns are photolithographically imaged over several layers on a single semiconducting wafer which, in turn, is cut into hundreds of identical dies or chips. Within each of the die layers, the circuit traces are isolated from the next layer by an insulating material. Inasmuch as it is difficult to photolithographically image a rough surface, it is desirable that the insulating layers are provided as having a smooth surface topography or, as is termed in the vernacular, a high degree of planarity. In this regard, a relatively rough surface topography may be manifested as a depth of filed problem resulting in poor resolution of the patterns of subsequently deposited layers, and, in the extreme, in the short circuiting of the device. As circuit densities in semiconductor dies continue to increase, any such defects become unacceptable and may render the circuit either inoperable or lower its performance to less than optimal.

To achieve the relatively high degree of planarity required for the production of substantially defect free IC dies, a chemical-mechanical polishing (CMP) process is becoming increasingly popular. Such process involves chemically etching the wafer surface in combination with mechanical polishing or grinding. This combined chemical and mechanical action allows for the controlled removal of material.

In essential operation, CMP is accomplished by holding the semiconductor wafer against a rotating polishing surface, or otherwise moving the wafer relative to the polishing surface, under controlled conditions of temperature, pressure, and chemical composition. The polishing surface, which may be a planar pad formed of a relatively soft and porous material such as a blown polyurethane, is wetted with a chemically reactive and abrasive aqueous slurry. The aqueous slurry, which may be either acidic or basic, typically includes abrasive particles, a reactive chemical agent such as a transition metal chelated salt or an oxidizer, and adjuvants such as solvents, buffers, and passivating agents. Within the slurry, the salt or other agent provides the chemical etching action, with the abrasive particles, in cooperation with the polishing pad, providing the mechanical polishing action. The basic CMP process is further described in the following U.S. Pat. Nos.: 5,993,647; 5,928,492; 5,895,315; 5,855,792; 5,791,970; 5,755,614; 5,709,593; 5,707,274; 5,705,435; 5,700,383; 5,665,201; 5,664,990; 5,658,185; 5,655,954; 5,650,039; 5,645,682; 5,643,406; 5,643,053; 5,637,185; 5,618,227; 5,607,718; 5,607,341; 5,597,443; 5,407,526; 5,395,801; 5,314,843; 5,232,875; and 5,084,071.

Looking to FIG. 1, a representative CMP process and apparatus therefor are illustrated schematically at 10. The apparatus 10 includes a wafer carrier, 12, for holding a semiconductor wafer or other workpiece, 14. A soft, resilient pad, 16, is positioned between wafer carrier 12 and wafer 14, with the wafer being held against the pad by a partial vacuum, frictionally, or with an adhesive. Wafer carrier 12 is provided to be continuously rotated by a drive motor, 18, in the direction referenced at 20, and additionally may be reciprocated transversely in the directions referenced at 22. In this regard, the combined rotational and transverse movements of the wafer 14 are intended to reduce the variability in the material removal rate across the work surface 23 of the wafer 14.

Apparatus 10 additionally includes a platen, 24, which is rotated in the direction referenced at 26, and on which is mounted a polishing pad, 28. As compared to wafer 14, platen 24 is provided as having a relatively large surface area to accommodate the translational movement of the wafer on the carrier 12 across the surface of the polishing pad 28.

A supply tube, 30, is mounted above platen 26 to deliver a stream of polishing slurry, referenced at 32, which is dripped or otherwise metered onto the surface of pad 28 from a nozzle or other outlet, 34, of the tube 30. The slurry 32 may be gravity fed from a tank or reservoir (not shown), or otherwise pumped through supply tube 30. Alternatively, slurry 32 may be supplied from below platen 26 such that it flows upwardly through the underside of polishing pad 28. Large volumes of water, typically de-ionized, also must be supplied through tube 30 to rinse the slurry from the wafer, to clean the pad and platen, and to keep the polishing pad wet in between polishing cycles.

In addition to the supply of slurry and water to the polishing pad, the CMN apparatus must accommodate the recirculation of the slurry and water process streams. In this regard, if the slurry flow is not maintained between polishing cycles or during down time, the particles in the slurry can agglomerate which results in an undesirable condition. The water stream also may be recirculated during the polishing cycles.

Heretofore, various arrangements of separate valves and associated controls have been employed to provide the required flow control functions for the slurry and water streams. These arrangements, however, often are relatively complex, and may not be fully versatile in function and control. It therefore it is believed that improvements in the design of control valves for CMP process equipment would be well-received by the semiconductor manufacturing industry.

SUMMARY OF THE INVENTION

The present invention is directed, broadly, to directional flow control valves such as are described in U.S. Pat. Nos. 3,357,451; 3,742,981; 3,744,518; 3,744,522; 3,827,453; 3,854,499; 3,858,485; 4,022,425; 4,051,868; 4,167,197; 4,274,443; 4,294,287; 4,495,962; 4,526,201; 5,992,294; an in EP 879,979 and GB 2,199,115. More particularly, the invention is directed to a multi-port valve of such variety which is of a spool-type construction. In having a capability of selectively controlling the flow of two process streams without intermixing of the streams, and in having a further capability of accommodating flow-through recirculation of the streams in different operational modes, the valve of the present invention is especially adapted for use in control the flow of slurry and water streams used in CMP processes.

As utilized in the CMP process, the valve, which may be pneumatically, hydraulically, electromechanical, or manually piloted or actuated, is de-energized or otherwise positional in a null mode to recirculate the slurry and water streams. In a first operational mode, such as during polishing of the wafer, the valve is energizable or otherwise positional to deliver a portion of the slurry flow through a supply outlet while maintaining the recirculation flows. In an alternate second operational mode, such as for rinse or stand-by, the valve is energizable or otherwise positionable to deliver a portion of the slurry flow through a supply outlet while again maintaining the recirculation flows.

It therefore is a feature of a disclosed embodiment of the present invention to provide a valve for use within a fluid system having a first and a second fluid stream. The valve includes a body having a bore with first and second inlet and outlet port openings for the fluid streams, and a third outlet port opening selectably couplable with the first and second inlet ports. A spool or other valve element is slidably received within the bore for axial movement therein, and is positionable within the bore in a null orientation closing the third outlet port to the first and second inlet ports. The spool is movable from the null orientation to a first operating orientation opening the third outlet port path to the first inlet port, and to a second operating orientation opening the third outlet port to the second inlet port.

It is a further feature of a disclosed embodiment of the present invention to provide a method of controlling the flow of a slurry stream from a slurry reservoir and a water stream from a water reservoir in a chemical-mechanical polishing (CMP) system having a supply line for delivering the slurry and water streams to a polishing pad. The method involves providing a valve including a body having a bore with first and second inlet ports for the streams, first and second outlet ports coupled to the reservoirs, and a third outlet port coupled to the supply line of the system. A spool or other valve element is slidably received within the bore for axial movement therein, and is positionable within the bore in a null orientation closing the third outlet port to the first and second inlet ports. The spool is shiftable from the null orientation to a first operating orientation opening the third outlet port path to the first inlet port, and to a second operating orientation opening the third outlet port to the second inlet port.

The present invention, accordingly, comprises the apparatus possessing the construction, combination of elements, and arrangement of parts which are exemplified in the detailed disclosure to follow. Advantages of the invention includes a valve construction which is cable of selectively controlling the flow of two fluid streams to multiple outlets, and which is of a compact and efficient structure affording reliable operation. Additional advantages include a valve construction which is economical to manufacture and assemble, and which may be fabricated entirely of a thermoplastic or other polymeric material such as a fluoropolymer which is chemically-resistant and meets the rigorous service requirements specified in semiconductor manufacturing. These and other advantages will be readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

Figure 1:
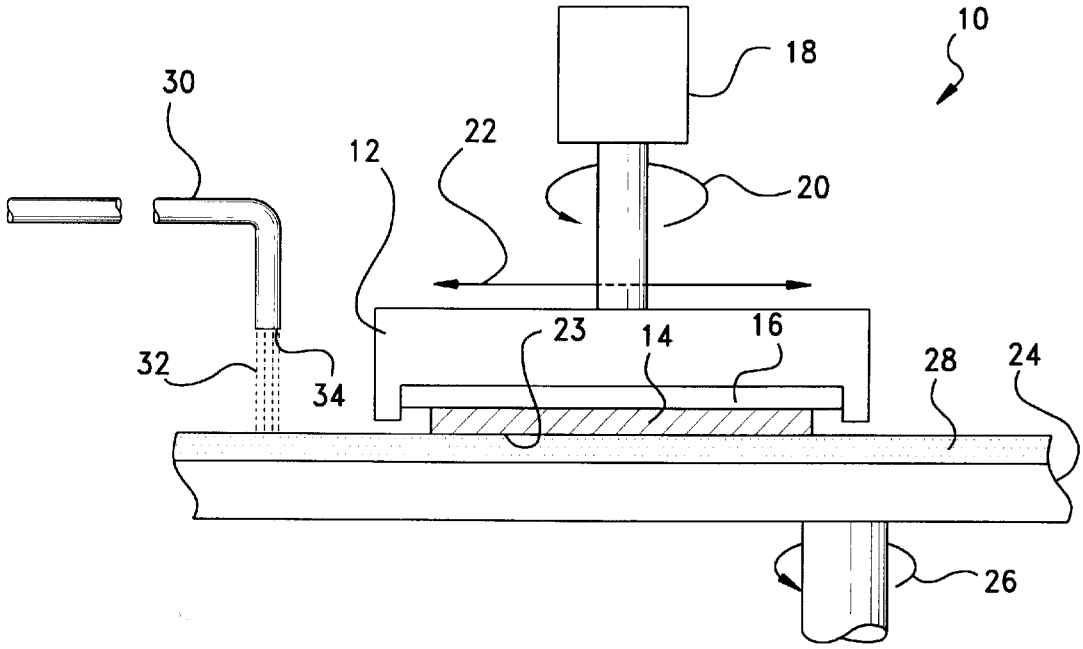
FIG. 1 is a schematic view of a representative CMP process.

The drawings will be described further in connection with the following Detailed Description of the Invention.

DETAILED DESCRIPTION OF THE INVENTION

Certain terminology may be employed in the following description for convenience rather than for any limiting purpose. For example, the terms "forward," "rearward," "right," "left," "upper," and "lower" designate directions in the drawings to which reference is made, with the terms "inward," "inner," or "inboard" and "outward," "outer," or "outboard" referring, respectively, to directions toward and away from the center of the referenced element, the terms "radial" and "axial" referring, respectively, to directions or planes perpendicular and parallel to the longitudinal central axis of the referenced element, and the terms "downstream" and "upstream" referring, respectively, to locations relative to the fluid flow. Terminology of similar import other than the words specifically mentioned above likewise is to be considered as being used for purposes of convenience rather than in any limiting sense.

For the purposes of the discourse to follow, the precepts of the control valve of the present invention are described in connection with a pneumatically-actuatable construction which is particularly adapted for flared tubing connections within a CMP system purification installation such as that shown in FIG. 1. It will be appreciated, however, that aspects of the present invention may find application in other fluid systems calling for similar operational modalities, but utilizing threaded, compression, or other connections, and/or requiring hydraulic, electromechanical, or even manual actuation. Use within those such other applications and with such other connections and/or actuation therefore should be considered to be expressly within the scope of the present invention.

Figure 2:
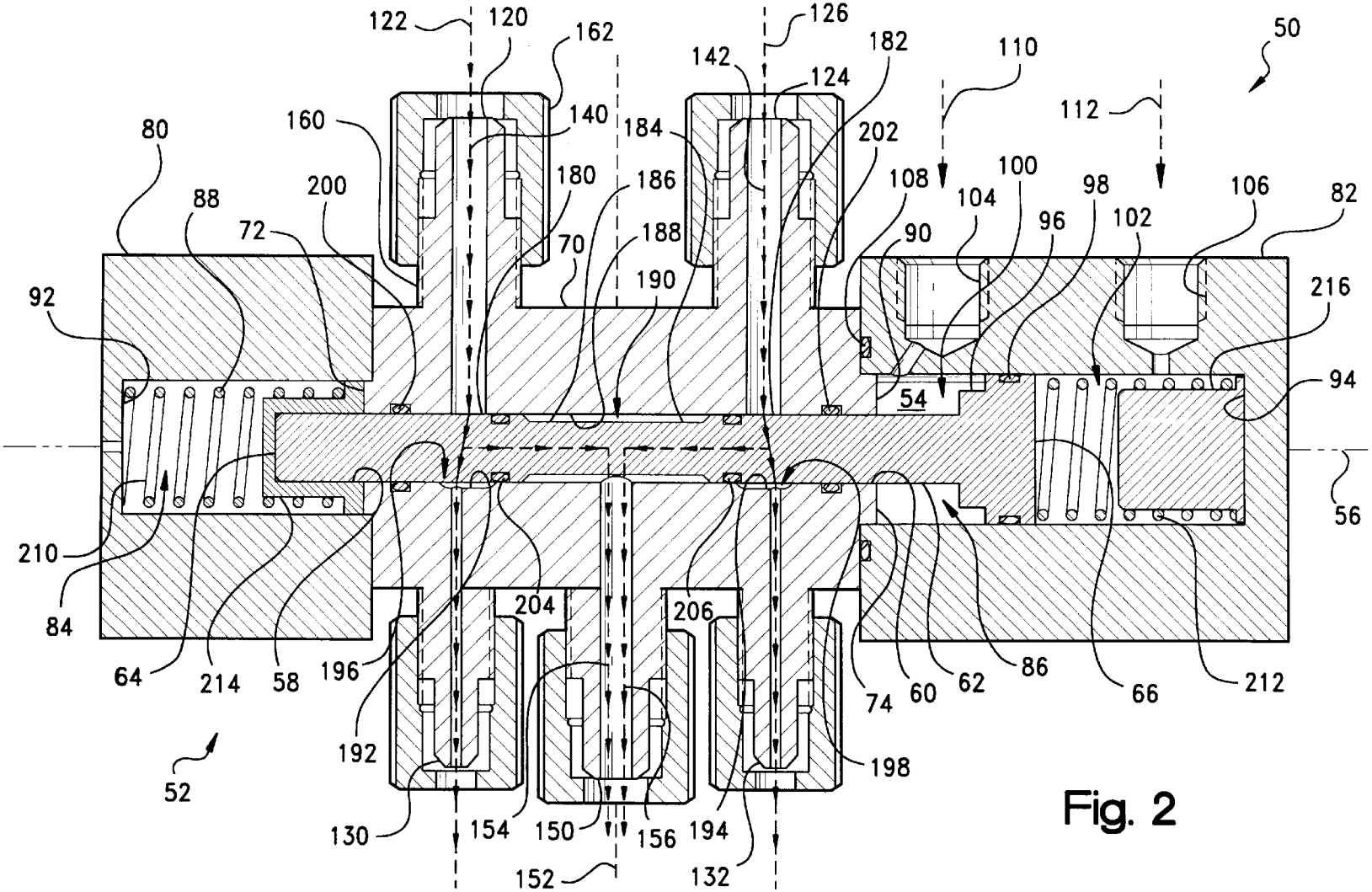
FIG. 2 is a cross-sectional view of an representative embodiment of a directional flow control valve construction according to the present invention as adapted particularly for incorporation within the CMP process of FIG. 1.

Referring then to the remaining figures, wherein corresponding reference numbers are used to designate corresponding elements throughout the several views, a valve construction in accordance with the present invention is shown generally at 50 in the cross-sectional views of FIGS. 2–3. With initial reference principally to FIG. 1, valve assembly 50 may be seen to include, in basic construction, a housing or body, referenced generally at 52, having a central bore, 54, which extends along a longitudinal axis, 56, in a rearward axial direction, i.e., towards the left of the figure, to a first end opening, 58, and in a forward axial direction, i.e. towards the right of the figure, to a second end opening, 60. A valve element, 62, which, as is shown, may be configured as an elongate, generally cylindrical spool is received within bore 54 for sliding axial movement along axis 56. Spool 62 extends along longitudinal axis 56 in the rearward direction to a first end, 64, and in the forward direction to a second end, 66, and is sized to have an axial length such that each of the ends 64 and 66 extends beyond the corresponding first and second end openings 58 and 60 of bore 54.

Although it may be of a unitary construction, body 52 is shown in the illustrative embodiment of FIG. 2 to be of a multi-piece construction including a central manifold portion, 70, having a generally-annular rearward end wall, 72, disposed radially about the bore first end opening 58, and an opposite, generally-annular forward end wall, 74, disposed radially about the bore second end opening 60. Manifold portion 70 is interposed between a first end cap portion, 80, which abuttingly engages the manifold portion rearward end wall 72, and a forward end cap portion, 82, which abuttingly engages the manifold portion forward end wall 74. Cap portions 80 and 82 define, respectively, a rearward chamber, 84, and a forward chamber, 86, each having, respectively, a first end wall, 88 and 90, defined by the corresponding rearward and forward end wall 72 and 74 of manifold portion 70, and second end wall, 92 and 94. Each of the rearward and forward chambers 84 and 86 receives a corresponding end 64 or 66 of spool 62 for sliding axial movement intermediate the corresponding first end walls 88 and 90, and second end walls 92 and 94 thereof.

The second end 66 of spool 62 is of an enlarged diametric extent which defines a piston head portion, 96, of spool 62. The spool piston head portion 92 is sealed within forward chamber 86 by means of a circumferential gland-mounted seal ring, 98, and defines a first plenum, 100, with the forward chamber first end wall 90, and a second plenum, 102, with the forward chamber second end wall 94. The plenums 100 and 102 each have a corresponding threaded or otherwise connectable first and second actuation port, 104 and 106, which open radially thereinto, are made fluid-tight by the interposition of a gland-mounted seal ring, 108, between the second cap portion 82 and the forward end wall 74 of the manifold portion 70. In this regard, spool 62 thereby may be made movable forwardly within bore 54 responsive to a pneumatic or other fluid control signal, represented at 110, of a first given input pressure admitted into the first plenum 100, and is movable rearwardly responsive to a second fluid control signal, represented at 112, of a second given input pressure admitted into the second plenum 102.

For the connection of valve 50 with the intended fluid system application, manifold portion 70 is configured as having a first inlet port, 120, which opens radially into bore 54 along a first radial axis, 122, disposed transverse to longitudinal axis 56, and a second inlet port, 124, which is spaced-apart axially from first inlet port 120 along longitudinal axis 56, and which similarly opens radially into bore 54 along a second radial axis, 126, disposed generally parallel to first radial axis 122. The first and second inlet ports 120 and 124 each is couplable in fluid communication with a respective first and second fluid stream, and have associated first and second outlet ports, 130 and 132, which are axially spaced-apart along longitudinal axis 56. Each of the first and second outlet ports 130 and 132, in turn, opens radially into bore 54, and may be disposed generally coaxially with the associated inlet port 120 or 124 along a radial axis 122 or 126. For the flow of the first and second streams through valve 50, the first outlet port 130 is coupled in fluid communication along a first fluid flow path, represented at 140, with the second outlet port 132 being coupled in fluid communication with the second inlet port 124 along a second fluid flow path, represented at 142, which is separated from the first fluid flow path by spool 62.

A third outlet port, 150, is provided to open radially into bore 54 along a third radial axis, 152, which is disposed generally parallel to the first and second radial axes 140 and 142, and at an axial location along longitudinal axis 56 which is intermediate the first and second outlet ports 130 and 132. In accordance with the precepts of the present invention, the third fluid outlet port 150 is selectable couplable in fluid communication with the first inlet port 120 along a third fluid flow path, 152, through valve 50 and, alternately, with the second inlet port 124 along a fourth flow path, 154.

As is shown in FIG. 2, each of the ports 120, 124, 130, 132, and 150 may be configured as being generally tubular and as having an externally threaded portion, one of which is referenced at 160 for port 120, and an associated nut, one of which is referenced at 162 for port 120, which is threadably engageable with threaded portion 160 for a flared or other tubing connection. It will be appreciated, however, that alternatively coupling arrangements may be envisioned depending upon the intended fluid application for valve 50. Such alternative configurations of ports 120, 124, 130, 132, and 150 therefore should be considered within the scope of the present invention herein involved. Moreover, although ports 120, 124, 130, 132, and 150 are shown for illustrative purposes to be generally coplanar or "in-line," alternative arrangements of the ports may be envisioned wherein the ports are not coplanar but are displaced angularly relative to longitudinal axis 56.

As aforementioned, spool 62 is slidably received within bore 54 for axial movement along longitudinal axis 56 in opposite forward and rearward directions. With momentary reference to FIGS. 3A–3C wherein the first and second fluid flow streams are represented at 170 and 172, respectively, it may be seen in FIG. 3A that spool 62 is positionable within bore 54 in a normal or null orientation closing the third and fourth fluid paths 154 and 156 to fluid flow while opening the first and second paths 140 and 142 to the respective flows of the first and second fluid streams 170 and 172. As controlled, for example, by the supply of pneumatic control signal 112, valve 50 is energizable to move spool 62 forwardly from the null orientation of FIG. 3A to the first operating orientation shown in FIG. 3B. In such orientation, the third fluid flow path 154 is opened to divert at least a portion of the flow of the first fluid stream 170 from the first path 140 which, along with the second path 142, may be maintained opened to the respective flows of the first and second streams 170 and 172, with the fourth path 156 being maintained closed to the flow of the second fluid stream 172. Alternately, upon the supply of pneumatic control signal 110, valve 50 is energizable to move spool 62 rearwardly from the null orientation of FIG. 3A to the second operating orientation shown in FIG. 3C. In this orientation, the fourth fluid flow path 156 is opened to divert at least a portion of the flow of the second fluid stream 172 from the second flow path 142 which, along with the first path 140 may be maintained opened to the respective flows of the first and second fluid streams 170 and 172, with the third path 150 being maintained closed to the flow of the first fluid stream 170. Thus, it will be appreciated that valve 50 of the present invention is controllable to effect two separate 3-way distribution valving functions, and therefore may replace two valves and their associated plumbing and controls in the intended fluid application.

With continuing reference to FIG. 2, spool 62 may be seen to be configured as having a first control portion, 180, which is positioned in the null orientation (FIG. 3A) in radial registration with the first inlet and outlet ports 120 and 130 so as to block the flow of the first fluid stream 170 through the third flow path 154, and a second control portion, 182, which is positioned in the null orientation (FIG. 3B) in radial registration with the second inlet and outlet ports 124 and 132 so as to block the flow of the second fluid stream 172 through the fourth flow path 156. As may be appreciated best with additional reference to FIG. 3C, the first control portion 180 is provided to having an axial length which is sized to extend intermediate the first inlet port 120 and the third outlet port 150 in the second operating orientation of spool 62 so as to maintain the closure of the third fluid path 156 to the flow of the first stream 170. Likewise, and as may be seen best with additional reference to FIG. 3B, the second control portion 182 similarly is provided to having an axial length which is sized to extend intermediate the second inlet port 124 and the third outlet port 150 in the first operating orientation of spool 62 so as to maintain the closure of the fourth fluid path 156 to the flow of the second stream 172.

Referring again to FIG. 2, spool 62 further is configured as having a connecting portion, 184, which extends intermediate the control portions 180 and 182, and is of a reduced diametric extent relative thereto. The outer surface, 186, of connecting portion 184 defines with the inner surface, 188, of bore 54 a generally annular, first radial channel, 190, which is coupled in fluid communication with the third outlet port 150. With additional reference again to FIG. 3B, channel 190 may be seen to have an axial length which is sized to span between the first inlet port 120 and the third outlet port 150 in the first operating orientation of spool 62 in defining the third fluid flow path 154 and, with reference again to FIG. 3C, between the second inlet port 124 and the third outlet port 150 in the second operating orientation of spool 62 in defining the fourth fluid flow path 156.

For coupling the first and second inlet ports 120 and 124 in fluid communication with their associated outlet port 130 or 132 to provide for fluid flow through the first and second paths 140 and 142 in all of the orientations of spool 62, bore 54 is shown in FIG. 2 to include a first groove, 192, which extends radially between the first inlet and outlet ports 120 and 130, and an axially-spaced apart second groove, 194, which extends radially between the second inlet and outlet ports 124 and 132. In the null and second operating orientations (FIGS. 3A and 3C) of spool 62, first groove 192 defines with the spool first control portion 180 a generally annular second radial channel, 196, coupling the first inlet port 120 in fluid communication with the first outlet port 130 along the first fluid flow path 140. Similarly, in the null and first operating orientations (FIGS. 3A and 3B) of spool 62, second groove 194 in turn defines with the spool first control portion 182 a generally annular third radial channel, 198, coupling the second inlet port 124 in fluid communication with the second outlet port 132 along the second fluid flow path 142. As may be seen in FIG. 3B, however, in the first operating orientation of spool 62, the first radial channel 196 coupling the first inlet port 120 in fluid communication with the first outlet port 130 is defined between the bore first groove 192 and the spool connecting portion 184. Likewise, and as may be seen in FIG. 3C, in the second operating orientation of spool 62, the second radial channel 198 coupling the second inlet port 124 in fluid communication with the first outlet port 132 is defined between the bore second groove 194 and, again, the spool connecting portion 184. Depending upon the control requirements of the intended application, grooves 192 and 194 alternatively may be formed within spool 62 such that the positioning thereof within bore 54 in the above-described modes effects the closing of the first fluid flow path 122 in, for example, the second operating orientation of spool 62, and, alternately, the closing of the second fluid flow path in, for example, the first operating orientation (FIG. 3A) of spool 62.

Returning once again to FIG. 2, radial channels 196 and 198 may be seen to be sealed in the rearward direction, in the case of channel 196, and in the forward direction, in the case of channel 198, via a corresponding seal ring, 200 and 202. One of the sealing rings 200 and 202 is gland-mounted at either end of body manifold portion 70 coaxially with bore 54 for a compressive, sealing engagement with the adjacent control end 180 or 182 of spool 62. For the additional sealing of the radial channels 196 and 198 in the opposite direction as depending upon the position of spool 62, a first and second seal ring, 204 and 206, are gland-mounted coaxially on spool 62 for sealing-tight sealing compression therebetween and the inner surface 188 of bore 54. In this regard, first seal ring 204 is mounted on spool 62 forwardly of seal 200 intermediate the first control portion 180 and the connecting portion 184 thereof to effect a first flight-tight seal between the spool and the bore. Second seal ring 206, in turn, is mounted on spool 62 rearwardly of seal 202 intermediate the second control portion 182 and the connecting portion 184 thereof to effect a second fluid-tight seal between the spool and bore forwardly of the first seal.

Figure 3A:
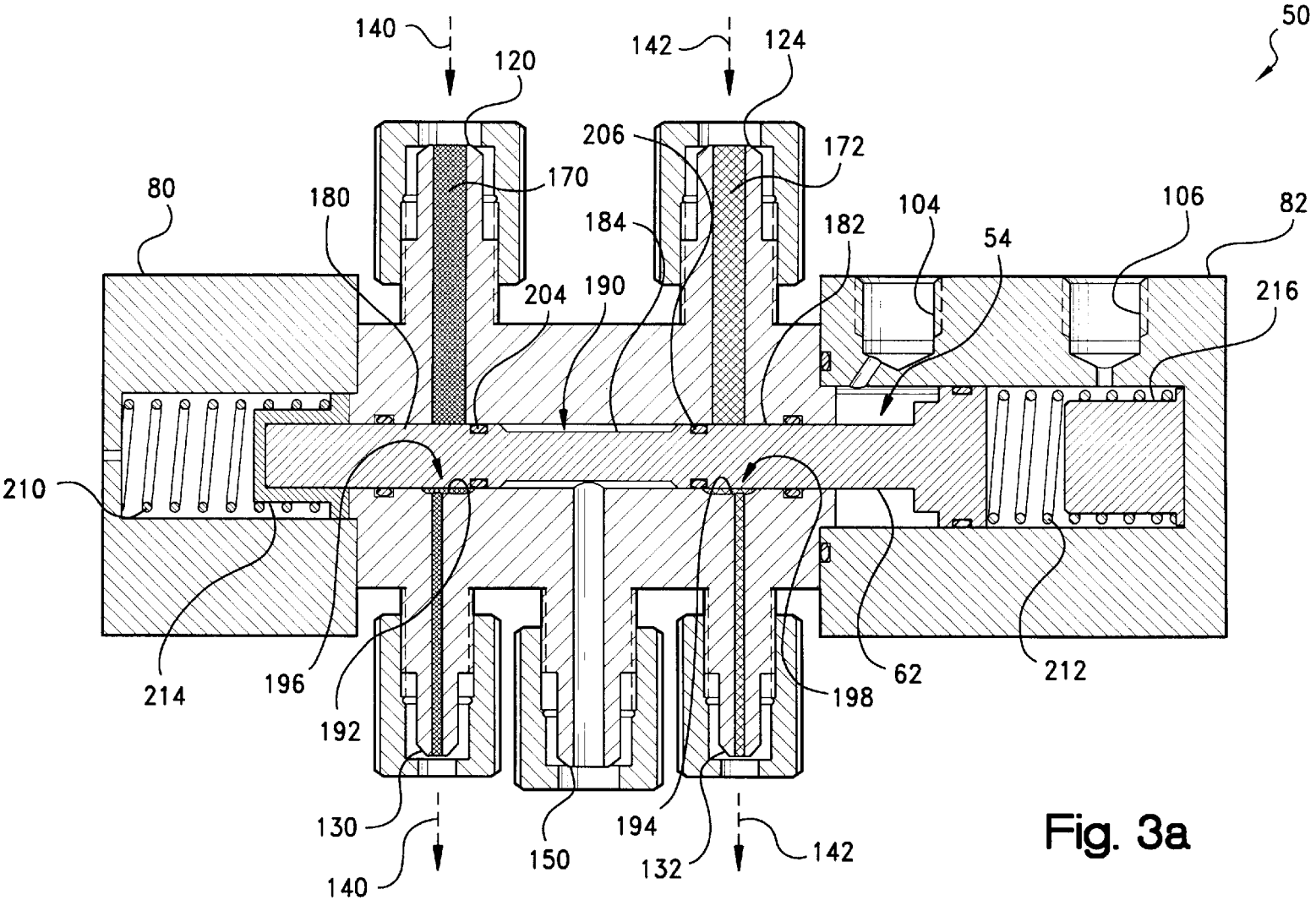
FIG. 3A is a cross-sectional view showing the control valve of FIG. 2 in a de-energized state.
Figure 3B:
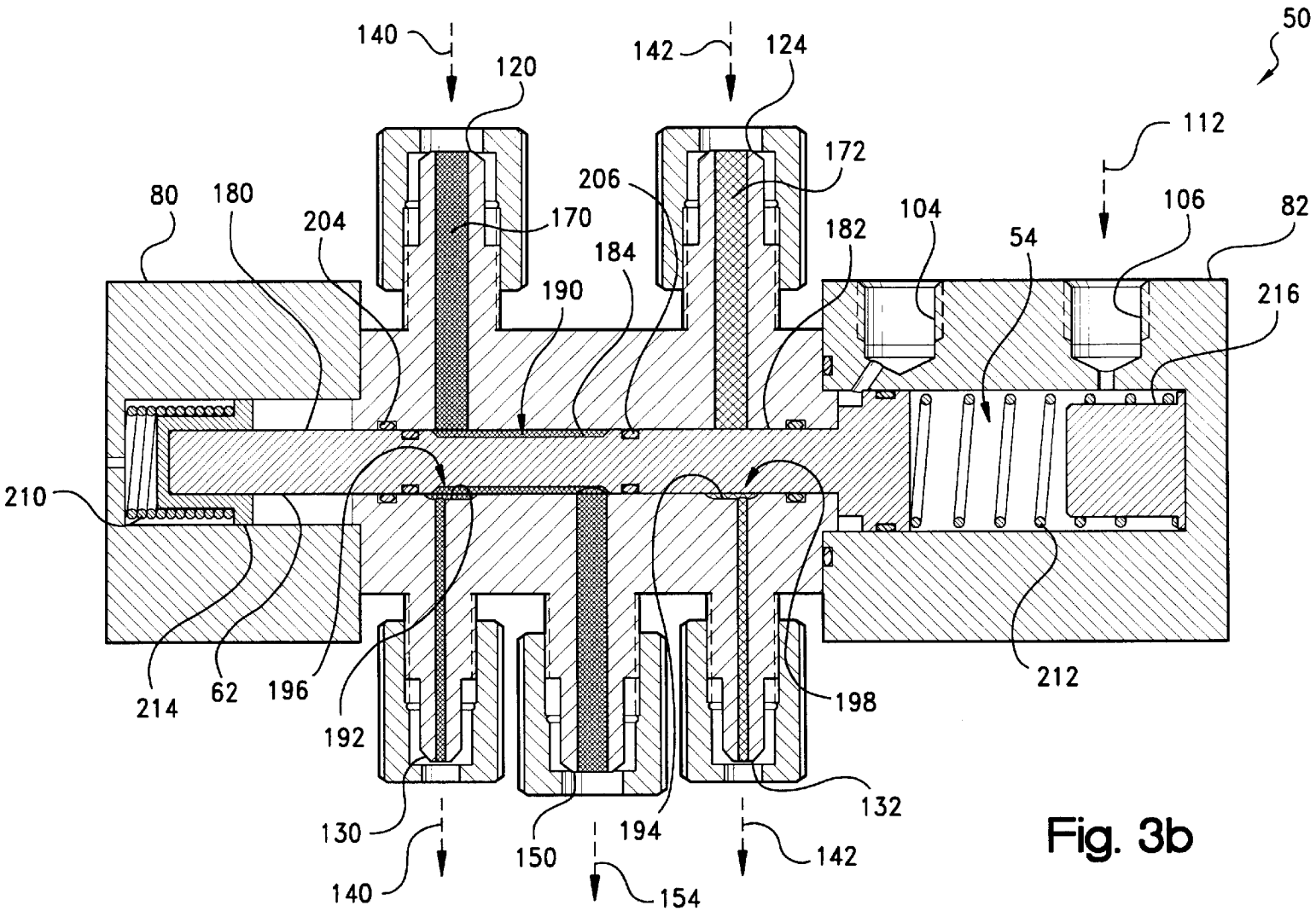
FIG. 3B is a cross-sectional view showing the control valve of FIG. 2 in a first energized state.
Figure 3C:
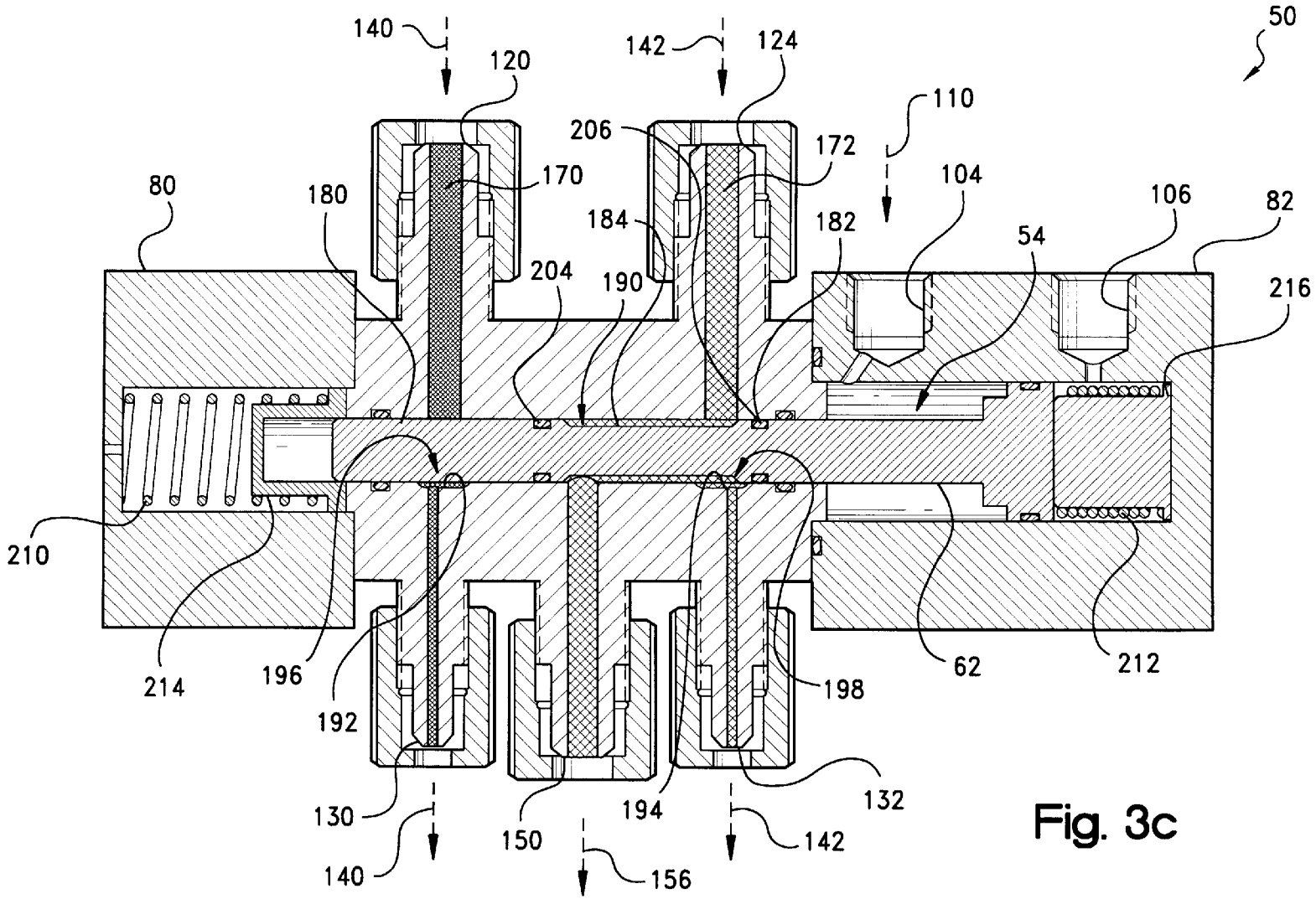
FIG. 3C is a cross-sectional view showing the control valve of FIG. 2 in a second energized state.

In operation, and as may be best appreciated with reference again to the several views of FIGS. 3A–3C, each of the seals 204 and 206 are disposed axially intermediate the first outlet port120, for seal 204, and the second outlet port 124, for seal 206, and the third outlet port 150 to effect the fluid tight closing of the third and fourth flow paths 154 and 156 to the first and second streams 170 and 172. In the first operating orientation of FIG. 3B, however, seal 204 is moved rearwardly past the first inlet port 120 so as to allow fluid communication thereof with channel 190, with seal 206 sill being positioned axially intermediate the second inlet port 124 and third outlet port 150 to maintain the fluid-tight closing of the fourth flow path 156 and additionally to provide a forward seal for channel 190 maintaining the isolation of the first and second flow streams 170 and 172. Alternately, in the second operating orientation of FIG. 3C, seal 206 is moved forwardly past the second inlet port 124 so as to allow fluid communication thereof with channel 190, with seal 204 still being positioned axially intermediate the first inlet port 120 and third outlet port 150 to maintain the fluid-tight closing of the third flow path 154 and additionally to provide a rearward seal for channel 190 maintaining the isolation of the first and second flow streams 170 and 172.

Looking now again to FIG. 2, and with additional reference to FIG. 3A, spool 62 will be appreciated to be normally-biased in its null orientation by means of a biasing assembly which includes a first biasing member, 210, interposed between the spool first end 64 and the second end wall 92 of rearward chamber 84 for urging spool 62 forwardly, an opposing second biasing member, 212, interposed between the spool piston head end 96 and the second end wall 94 of forward chamber 102 for urging spool 62 rearwardly. In the illustrative embodiment of FIGS. 2 and 3, the first and second biasing members 210 and 212 are shown to be provided as compressible springs which are selected as having spring constants to center or otherwise balance spool 62 in its null orientation. hi this regard, spring 210 is retained coaxially with a generally U-shaped first spool stop, 214, over the spool first end 64 for compression therebetween and the chamber second end wall 92. Spring 212, in turn is mounted coaxial over a generally-cylindrical second spool stop, 212, which bears against the chamber second end wall 94 for compression therebetween the wall 94 and the spool piston head end 96. Typically, spring 212 will be selected as having a spring constant less than that of spring 210 to ensure that spool 62 is positively positioned in its null orientation by the abutting engagement of stop 214 against the manifold portion rearward end wall 72 as is shown in FIG. 3A. With reference to FIGS. 3B–C, it further may be seen the travel of spool 62 is delimited in the first orientation (FIG. 3B) thereof in the rearward direction by the engagement of the piston head end 96 against the manifold forward end wall 74, and in the second orientation (FIG. 3C) thereof in forward direction by the abutting engagement of the spool piston head end 96 against the stop 216.

Figure 4A:
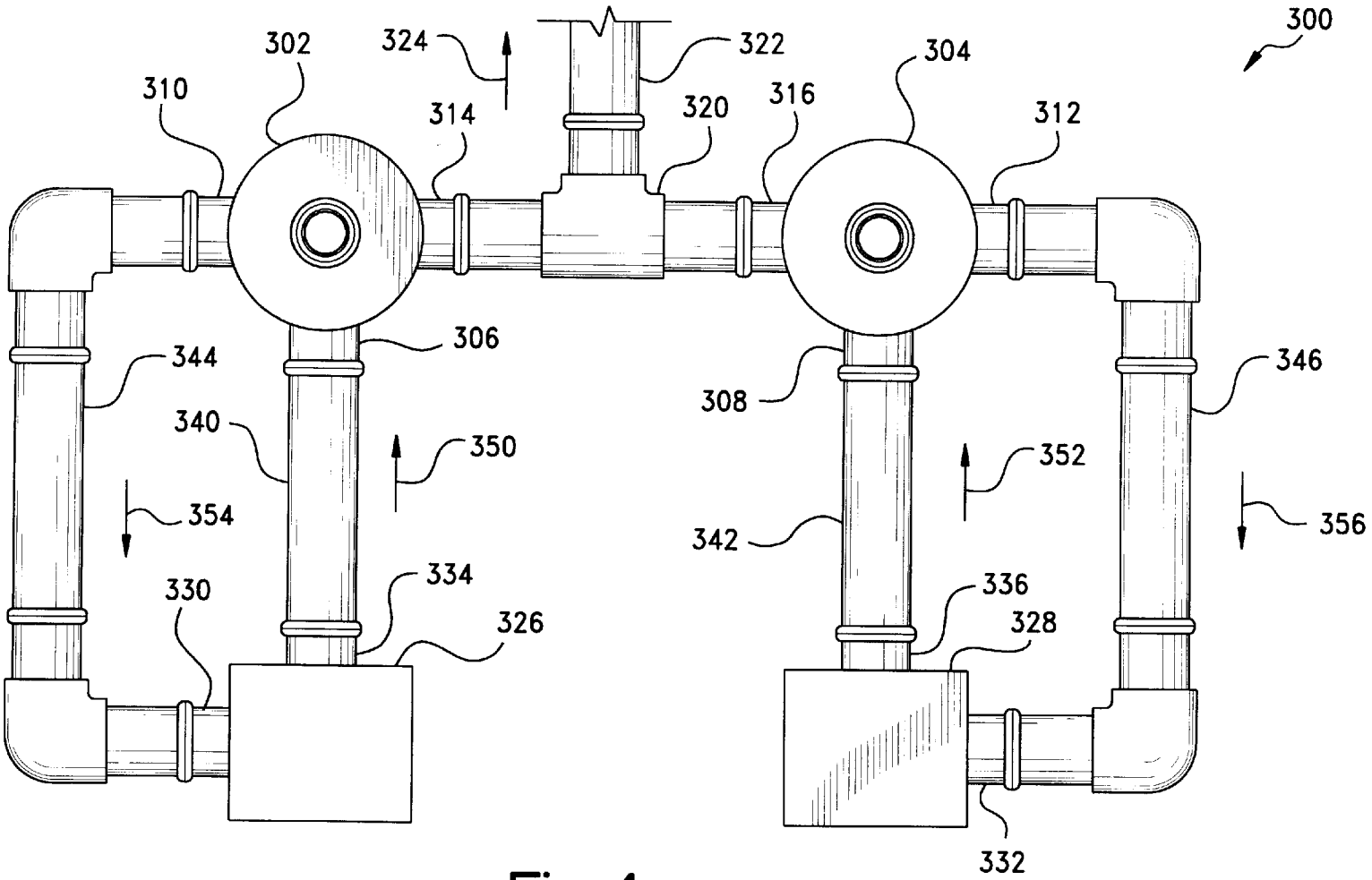
Fig. 4a (PRIOR ART)
FIG. 4A is a schematic diagram of a representative CMP circuit according to the prior art.
Figure 4B:
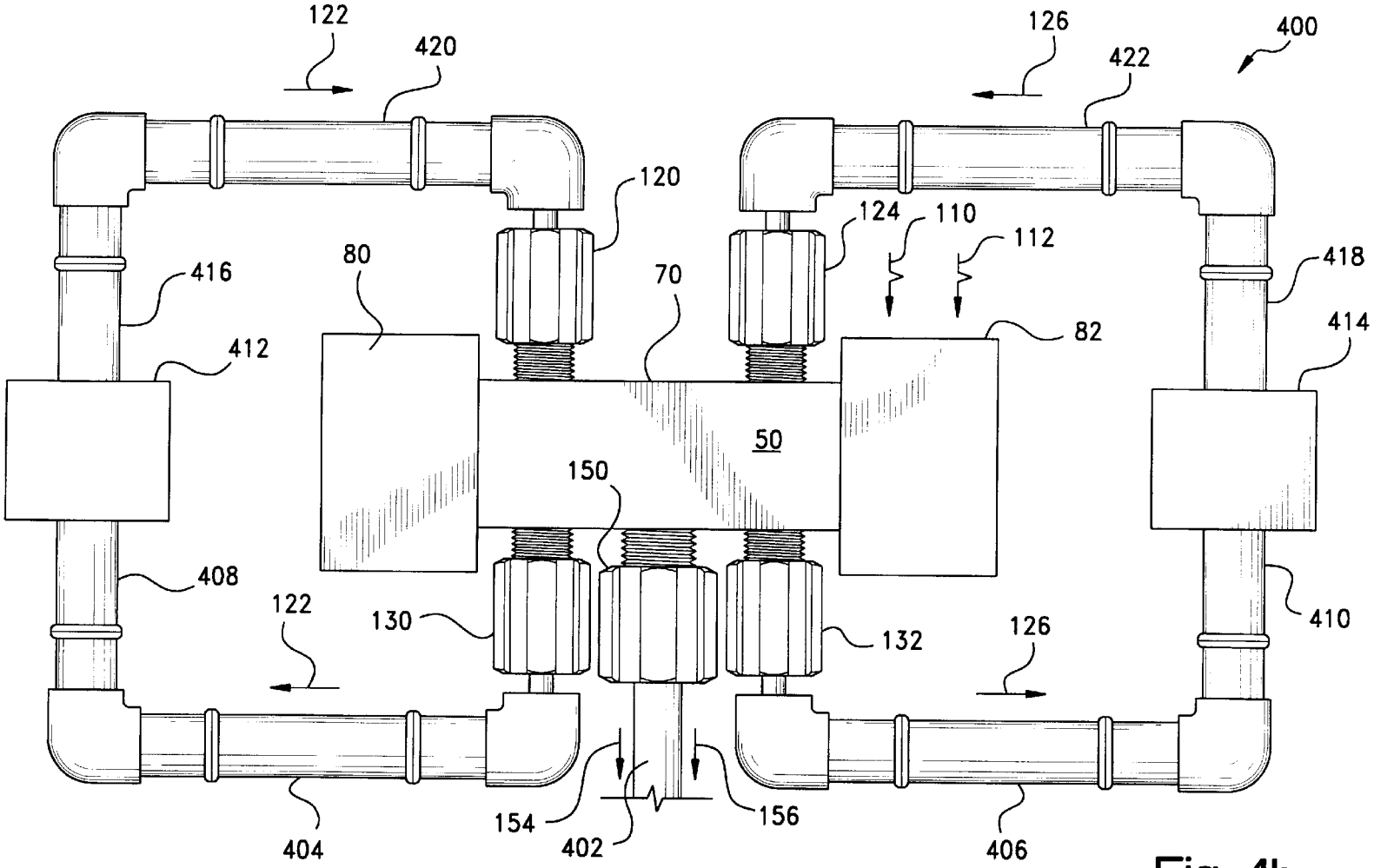
FIG. 4B is a schematic diagram of a representative CMP circuit according to the present invention including the control valve of FIG. 2.

Considering lastly the CMP installations of FIGS. 4A and 4B, a representative installation circuit according to the prior art is shown generally at 300. Within such installation circuit, a pair of 3-way valves, 302 and 304, are provided as having, respectively, an inlet port, 306 and 308, a first outlet port, 310 and 312, and a second outlet port, 314 and 316. The second outlet ports 314 and 316 of the valves 302 and 304 each are connected via a tee or other fitting, 320, to a supply line, 322, which delivers in the direction shown by arrow 324 alternate flows of slurry and de-ionized water from the respective slurry and water tanks, 326 and 328, to a polishing pad (not shown in FIG. 4A), such as pad 28 of FIG. 1. Tanks 326 and 328 each have, respectively, an inlet, 330 and 332, and an outlet, 334 and 336. Each of the valve inlet ports 306 and 308 is connected, respectively, to a tank outlet port 334 or 336 via an associated tubing run or other line 340 or 342, with the valve first outlet ports 310 and 312, in turn, being connected to an associated one of the tank inlet ports 330 or 332 via an associated tubing run 344 or 346.

With valves 302 and 304 being connected as described within circuit 300, water and slurry flows are supplied to the valves in the direction shown by arrow 350 for valve 302 and by arrow 352 for valve 304. These flows are recirculated to tank in the direction shown by arrow 354 for valve 302 and arrow 356 for valve 304, and, depending on the valve settings, additionally are divertable through the second outlet ports 314 and 316 to supply line 322.

Turning to FIG. 4B, a representative installation circuit according to the present invention is shown generally at 400 for purposed of comparison with circuit 300 of the prior art. Advantageously within installation circuit 400, the 3-way valves 302 and 304 of circuit 300, along with their associated controls and tubing, are replaced by valve 50 of the present invention. In this regard, the third outlet port 150 of valve 50 is connected to a the supply line, 402, of the circuit, with the first and second outlet ports 130 and 132 being coupled via, respectively, the tubing runs 404 and 406 to the corresponding inlet 408 or 410 of slurry tank 412 or water tank 414. The first and second inlet ports 120 and 124 of valve 50, in turn, are connected in fluid communication with the corresponding outlet 416 or 418 of tank 412 or 414 via an associated tubing run 420 or 422.

With valve 50 being connected as described within circuit 400, the circuit may be controlled in a stand-by mode with valve 50 being de-energized to provide recirculation flows of slurry and water along the corresponding first and second flow paths 122 and 126. Alternately, valve 50 is energizable responsive to the supply of second control signal 112 for the control of circuit 400 in a first operational mode maintaining the recirculation flows 122 and 126, and additionally diverting a portion of the slurry flow 122 to supply line 402 along the third flow path 154. Alternately, valve 50 is energizable responsive to the supply of first control signal 110 for the control of circuit 400 in a second operational mode again maintaining the recirculation flows 122 and 126, but now additionally diverting a portion of the water flow 126 to supply line 402 along the fourth flow path 156.

Thus, a unique valve construction is described which is controllable to effect two separate 3-way distribution valving functions, and therefore may replace two valves and their associated plumbing and controls in the intended fluid application.

Depending upon its material of construction, the valve assembly of the present invention are may be fabricated by molding, forging, machining, or other conventional forming processes. Unless otherwise specified, materials of construction are to be considered conventional for the uses involved. Such materials generally will be corrosion resistant and otherwise selected for compatibility with the fluid being transferred or for desired mechanical properties. Preferred materials of construction include plastics and other polymeric materials, as well as ferrous or nonferrous metals such as mild steel, stainless steel, and brass. Preferred plastic materials include poly(ether ether ketones), polyimides, high molecular weight polyethylenes, polyetherimides, polybutylene terephthalates, nylons, fluoropolymers, polysulfones, polypropylenes, polyesters, polyethylene terephthalate, acetal homo and copolymers, and polyvinyl chloride, with, particularly, fluoropolymers such as polytetrafluoroethylene being preferred for CMP applications. Preferred materials for the valve seals include plastics and elastomers such as SBR, polybutadiene, EPDM, butyl, neoprene, nitrile, polyisoprene, silicone, fluorosilicone, buna-N, and copolymer rubbers, with fluoropolymers again being preferred CMP applications.

As it is anticipated that certain changes may be made in the present invention without departing from the precepts herein involved, it is intended that all matter contained in the foregoing description shall be interpreted in as illustrative rather than in a limiting sense. All references cited herein are expressly incorporated by reference.

What is claimed is:

1. A method of controlling the flow of a slurry stream from a slurry reservoir and a water stream from a water reservoir in a chemical-mechanical polishing (CMP) system having a supply line for delivering the slurry and water streams to a polishing pad, said method comprising the steps of:

(a) providing a valve comprising:

a body including:

a bore extending axially along a longitudinal axis;

a first inlet port opening radially into said bore and coupled in fluid communication with the slurry stream, and a second inlet port opening radially into said bore, said second inlet port being spaced-apart axially from said first inlet port along said longitudinal axis and being coupled in fluid communication with the water stream;

a first outlet port coupled in fluid communication with the slurry reservoir and opening radially into said bore, said first outlet port being couplable in fluid communication with said first inlet port along a first fluid flow path through said body, and a second outlet port coupled in fluid communication with the water reservoir and opening radially into said bore, said second outlet port being spaced-apart axially from said first outlet port along said longitudinal axis and being couplable in fluid communication with said second inlet port along a second fluid flow path through said body separated from said first fluid flow path; and a third outlet port coupled in fluid communication with said supply line and opening radially into said bore axially intermediate said first and said second outlet port along said longitudinal axis, said third fluid port being selectably couplable in fluid communication with said first inlet port along a third fluid flow path through said body and, alternately, said second inlet port along a fourth fluid flow path through said body; and a valve element slidably received within said bore for axial movement along said longitudinal axis in a forward direction and in an opposite rearward axial direction;

(b) positioning said valve element within said bore in a null orientation closing said third and said fourth fluid flow path;

(c) shifting said valve element from said null orientation in said forward direction to a first operating orientation opening said third fluid flow path to said slurry stream and closing said fourth fluid flow path to said water stream; and (d) alternately shifting said valve element in said rearward direction to a second operating orientation opening said fourth fluid flow path to said water stream and closing said third fluid flow path to said slurry stream.

2. The method of claim 1 wherein said valve element is configured as an elongate spool including:

a first control portion positioned in said null orientation of said valve element in radial registration with said first inlet port and said first outlet port closing said third fluid flow path to said slurry stream, said first control portion having an axial length sized to extend intermediate said first inlet port and said third outlet port in said second operating orientation of said valve element to close said third fluid flow path;

a second control portion positioned in said null orientation of said valve element in radial registration with said second inlet port and said second outlet port closing said fourth fluid flow path to said water stream, said second control portion having an axial length sized to extend intermediate said second inlet port and said third outlet port in said first operating orientation of said valve element to close said fourth fluid flow path; and a connecting portion extending intermediate said first and said second control portion, said connecting portion defining with said bore a first radial channel coupled in fluid communication with said third outlet port, said channel having an axial length sized to span between said first inlet port and said third outlet port in said first operating orientation of said valve element to define said third fluid flow path, and between said second inlet port and said third outlet port in said second operating orientation of said valve element to define said fourth fluid flow path.

3. The method of claim 2 wherein said bore is formed as having a first groove portion extending radially between said first inlet port and said first outlet port, and a second groove portion spaced-apart axially from said first groove portion and extending radially between said second inlet port and said second outlet port, said first groove portion defining with said first control portion of said spool in the null and second operating orientations of said valve element a second radial channel coupling said first inlet port in fluid communication with said first outlet port along said first fluid flow path, and said second groove portion defining with said second control portion of said spool in the null and first operating orientations of said valve element a third radial channel coupling said second inlet port in fluid communication with said second outlet port along said second fluid flow path.

4. The method of claim 3 wherein said second radial channel coupling said first inlet port in fluid communication with said first outlet port is defined in said first operating orientation of said valve element between said first groove portion of said bore and said connecting portion of said spool, and wherein said third radial channel coupling said second inlet port in fluid communication with said second outlet port is defined in said second operating orientation of said valve element between said second groove portion of said bore and said connecting portion of said spool.

5. The method of claim 2 wherein said valve further comprises:

a generally-annular first sealing member mounted coaxially on said spool intermediate said first control portion and said connecting portion to effect a first flighttight seal between said spool and said bore; and a generally-annular second sealing member mounted coaxially on said spool intermediate said second control portion and said connecting portion to effect a second flight-tight seal between said spool and said bore, wherein said first sealing member in the null and second operating orientations of said valve element is disposed axially intermediate said first inlet port and said third outlet port to close said third fluid flow path, and in the first operating orientation of said valve is moved rearwardly past said first inlet port, and wherein said second sealing member in the null and first operating orientations of said valve element is disposed axially intermediate said second inlet port and said third outlet port to close said fourth fluid flow path, and in the second operating orientation of said valve is moved rearwardly past said second inlet port.

6. The method of claim 1 wherein said first inlet port and said first outlet port each opens radially into said bore along a first radial axis disposed transverse to said longitudinal axis, and wherein said second inlet port and said second outlet port each opens radially into said bore along a second radial axis disposed generally parallel to said first radial axis.

7. The method of claim 6 wherein said third outlet port opens radially into said bore along a third radial axis disposed generally parallel to said first and said second radial axis.

8. The method of claim 2 wherein:

said spool extends along said longitudinal axis in said rearward direction to a first end and in said forward direction to a second end, said second end being configured to define a piston head, and said body further includes a forward chamber extending along said longitudinal axis and having a first end wall and a second end wall, said piston head of said spool being slidably received within said first chamber through the first end wall thereof for axial movement along said longitudinal axis intermediate the first and the second end wall thereof, and defining with the first end wall a first plenum of said forward chamber having a first actuation port opening radially thereinto, and with the second end wall a second plenum of said first chamber having a second actuation port opening radially thereinto; and said spool is shifted axially within said bore in step (c) responsive to a first fluid control signal of a given input pressure admitted into said first plenum, and in step (d) responsive to a second fluid control signal of a given input pressure admitted into said second plenum.

9. The method of claim 8 wherein said body further includes a rearward chamber extending along said longitudinal axis and having a first end wall and a second end wall, said second end of said spool being slidably received within said rearward chamber through the first end wall thereof for axial movement along said longitudinal axis intermediate the first and the second end wall thereof, and wherein said valve further comprises a biasing assembly for normally positioning in step (b) said spool in said null orientation, said biasing assembly comprising:

a first biasing member interposed between the first end of said spool and the second end wall of said rearward chamber for urging said spool in said forward direction; and a second biasing member interposed between said piston head of said spool and the second end wall of said forward chamber for urging said spool in said rearward direction.

10. The method of claim 9 wherein said first biasing member is a first compressible spring having a first spring constant, and wherein said second biasing member is a second compressible spring having a second spring constant, said first and said second spring constant being selected to balance said spool in said null orientation.

11. A valve for use within a fluid system having a first and a second fluid stream, said valve comprising:

a body including:

a bore extending axially along a longitudinal axis;

a first inlet port opening radially into said bore and couplable in fluid communication with said first fluid stream, and a second inlet port opening radially into said bore, said second inlet port being spaced-apart axially from said first inlet port along said longitudinal axis and being couplable in fluid communication with said second fluid stream;

a first outlet port opening radially into said bore and couplable in fluid communication with said first inlet port along a first fluid flow path through said body, and a second outlet port opening radially into said bore, said second outlet port being spaced-apart axially from said first outlet port along said longitudinal axis and being couplable in fluid communication with said second inlet port along a second fluid flow path through said body separated from said first fluid flow path; and a third outlet port opening radially into said bore axially intermediate said first and said second outlet port along said longitudinal axis, said third fluid port being selectably couplable in fluid communication with said first inlet port along a third fluid flow path through said body and, alternately, said second inlet port along a fourth fluid flow path through said body; and a valve element slidably received within said bore for axial movement along said longitudinal axis in a forward direction and in an opposite rearward direction, said valve element being positionable within said bore in a null orientation closing said third and said fourth fluid flow path, and said valve element being movable from said null orientation in said forward direction to a first operating orientation opening said third fluid flow path to said first fluid stream and closing said fourth fluid flow path to said second fluid stream, and in said rearward direction to a second operating orientation opening said fourth fluid flow path to said second fluid stream and closing said third fluid flow path to said first fluid stream.

12. The valve of claim 11 wherein said valve element is configured as an elongate spool including:

a first control portion positioned in said null orientation of said valve element in radial registration with said first inlet port and said first outlet port closing said third fluid flow path to said first fluid stream, said first control portion having an axial length sized to extend intermediate said first inlet port and said third outlet port in said second operating orientation of said valve element to close said third fluid flow path;

a second control portion positioned in said null orientation of said valve element in radial registration with said second inlet port and said second outlet port closing said fourth fluid flow path to said second fluid stream, said second control portion having an axial length sized to extend intermediate said second inlet port and said third outlet port in said first operating orientation of said valve element to close said fourth fluid flow path; and a connecting portion extending intermediate said first and said second control portion, said connecting portion defining with said bore a first radial channel coupled in fluid communication with said third outlet port, said channel having an axial length sized to span between said first inlet port and said third outlet port in said first operating orientation of said valve element to define said third fluid flow path, and between said second inlet port and said third outlet port in said second operating orientation of said valve element to define said fourth fluid flow path.

13. The valve of claim 12 wherein said bore is formed as having a first groove portion extending radially between said first inlet port and said first outlet port, and a second groove portion spaced-apart axially from said first groove portion and extending radially between said second inlet port and said second outlet port, said first groove portion defining with said first control portion of said spool in the null and second operating orientations of said valve element a second radial channel coupling said first inlet port in fluid communication with said first outlet port along said first fluid flow path, and said second groove portion defining with said second control portion of said spool in the null and first operating orientations of said valve element a third radial channel coupling said second inlet port in fluid communication with said second outlet port along said second fluid flow path.

14. The valve of claim 13 wherein said second radial channel coupling said first inlet port in fluid communication with said first outlet port is defined in said first operating orientation of said valve element between said first groove portion of said bore and said connecting portion of said spool, and wherein said third radial channel coupling said second inlet port in fluid communication with said second outlet port is defined in said second operating orientation of said valve element between said second groove portion of said bore and said connecting portion of said spool.

15. The valve of claim 12 wherein said valve further comprises:

a generally-annular first sealing member mounted coaxially on said spool intermediate said first control portion and said connecting portion to effect a first flight-tight seal between said spool and said bore; and a generally-annular second sealing member mounted coaxially on said spool intermediate said second control portion and said connecting portion to effect a second flight-tight seal between said spool and said bore, wherein said first sealing member in the null and second operating orientations of said valve element is disposed axially intermediate said first inlet port and said third outlet port to close said third fluid flow path, and in the first operating orientation of said valve is moved rearwardly past said first inlet port, and wherein said second sealing member in the null and first operating orientations of said valve element is disposed axially intermediate said second inlet port and said third outlet port to close said fourth fluid flow path, and in the second operating orientation of said valve is moved forwardly past said second inlet port.

16. The valve of claim 1 wherein said first inlet port and said first outlet port each opens radially into said bore along a first radial axis disposed transverse to said longitudinal axis, and wherein said second inlet port and said second outlet port each opens radially into said bore along a second radial axis disposed generally parallel to said first radial axis.

17. The valve of claim 6 wherein said third outlet port opens radially into said bore along a third radial axis disposed generally parallel to said first and said second radial axis.

18. The valve of claim 12 wherein:

said spool extends along said longitudinal axis in said rearward direction to a first end and in said forward direction to a second end, said second end being configured to define a piston head;

said body further includes a forward chamber extending along said longitudinal axis and having a first end wall and a second end wall, said piston head of said spool being slidably received within said forward chamber through said first end wall thereof for axial movement along said longitudinal axis intermediate the first and the second end wall thereof, and defining with the first end wall a first plenum of said forward chamber having a first actuation port opening radially thereinto, and with the second end wall a second plenum of said forward chamber having a second actuation port opening radially thereinto; and said spool being movable axially within said bore in said forward direction responsive to a first fluid control signal of a given input pressure admitted into said first plenum, and in said rearward direction responsive to a second fluid control signal of a given input pressure admitted into said second plenum.

19. The valve of claim 18 wherein said body further includes a rearward chamber extending along said longitudinal axis and having a first end wall and a second end wall, said second end of said spool being slidably received within said rearward chamber through said first end wall thereof for axial movement along said longitudinal axis intermediate the first and the second end wall thereof, and wherein said valve further comprises a biasing assembly for normally positioning said spool in said null orientation, said biasing assembly comprising:

a first biasing member interposed between the first end of said spool and the second end wall of said rearward chamber for urging said spool in said forward direction; and a second biasing member interposed between said piston head of said spool and the second end wall of said forward chamber for urging said spool in said rearward direction.

20. The valve of claim 19 wherein said first biasing member is a first compressible spring having a first spring constant, and wherein said second biasing member is a second compressible spring having a second spring constant, said first and said second spring constant being selected to balance said spool in said null orientation.

* * * * *